United States Patent [19]

Gagnon

[11] Patent Number: 4,967,823

[45] Date of Patent: Nov. 6, 1990

[54] VERTICAL BLIND CHARIOT

[75] Inventor: Gilles Gagnon, St. Louis de Terrebonne, Canada

[73] Assignee: Groupe Plastique Moderne Inc., Boucherville, Canada

[21] Appl. No.: 280,813

[22] Filed: Dec. 7, 1988

[51] Int. Cl.[5] ..... E06B 9/38

[52] U.S. Cl. ..... 160/177; 160/168.1; 160/900

[58] Field of Search ..... 160/177, 176.1, 168.1, 160/173, 900, 172

[56] References Cited

U.S. PATENT DOCUMENTS

| | | | |
|---|---|---|---|
| 3,190,346 | 6/1965 | Arena et al. | 160/172 |
| 3,298,425 | 1/1967 | Cayton et al. | 160/176.1 |
| 3,500,896 | 3/1970 | Endou | 160/168.1 |
| 4,103,727 | 8/1978 | Spohr | 160/176.1 X |
| 4,140,169 | 2/1979 | Arena | 160/178.1 |
| 4,193,438 | 3/1980 | Pastore | 160/168.1 |
| 4,267,875 | 5/1981 | Koks | 160/176.1 |
| 4,306,608 | 12/1981 | Frentzel et al. | 160/177 X |
| 4,332,288 | 6/1982 | Frentzel et al. | 160/176.1 |
| 4,335,775 | 6/1982 | Frentzel et al. | 160/177 |
| 4,559,670 | 12/1985 | Wyatt | 160/177 X |
| 4,616,688 | 10/1896 | Agos | 160/176.1 |
| 4,628,981 | 12/1986 | Ciriaci et al. | 160/168.1 X |
| 4,732,202 | 3/1988 | Anderson | 160/177 X |
| 4,759,397 | 7/1988 | Walther | 160/900 X |

FOREIGN PATENT DOCUMENTS

| | | | |
|---|---|---|---|
| 2912257 | 10/1980 | Fed. Rep. of Germany | 160/900 |

*Primary Examiner*—David M. Purol

*Attorney, Agent, or Firm*—Foley & Lardner, Schwartz, Jeffery, Schwaab, Mack, Blumenthal & Evans

[57] ABSTRACT

A carrier for supporting a slat of a vertical blind. It includes a central section provided with a rotary slat suspender; a drive section provided with an actuating mechanism for rotation of the slat suspender and a connection section provided with a pull-bar, molded solid with the body of the connection section. The slat suspender is made up of two readily detachable parts coming apart when the part holding the slat is subjected to a pull force deemed excessive and dangerous. The drive section includes a combination worm-clutch and drive shaft allowing continued rotation of some of the slat suspenders, when the others have stopped, to permit them to reach the same stop position as the others.

22 Claims, 7 Drawing Sheets

VERTICAL BLIND CHARIOT

BACKGROUND OF THE INVENTION

1. Field of the invention

The present invention relates to improvements in a carrier for vertically supporting a slat also called "louver" of a vertical blind.

1. Description of the prior art

More specifically, the invention has to do with a carrier for vertical blind, which includes a body slidably mounted onto a supporting rail and generally having a central section provided with a rotary slat suspender; a drive section, on one side of the central section, carrying an actuating mechanism for use in rotating the slat suspender upon actuation of an endless cord usually positioned at one end of the rail; and a connection section on the other side of the central section for operatively joining the carrier to an adjacent carrier so that all carriers may be moved to one side of the window opening to uncover it or be spread out over the full breadth, the slats being then equally spaced from one another. In the latter position, the slats may be pivoted an angle of 180° about their longitudinal axis by the actuating mechanism. All pieces of a carrier are molded in plastic material.

In known blind installations of this type, the slat suspender is an one-piece element having a gear-like toothed end lodged in a chamber of the central section and a suspension end to which the slat is mounted; the toothed end meshing with a rotary worm of the drive section. The slat suspender is held fairly solidly in the central chamber and it requires a relatively strong pull on the slat to remove it from the chamber. Now, young, children are often tempted to pull on the slats precisely to disconnect them from the carrier. As the selected slat resists, the child applies a stronger pull. When the carrier finally gives out, the slat very abruptly becomes free and the child may often be seriously injured by suddenly loosing his balance and falling on the floor or hitting himself on a piece of furniture.

Under some circumstances, the rail with all the carriers and slats may also fall down and seriously injure the child. Moreover, in all cases the whole carrier is to be replaced, which may be sometimes very expansive.

With existing installations also, it sometimes happens that some of the slats fall out of line and do not lie in the same general plane as the others, when the blind is closed, nor are they parallel with them when opened and no provision is made to correct the situation readily so that complicated adjustment has to be made by acting on each of the faulty carrier.

It is also noted that, in prior art blinds of this general type, the pull-bar that connects one carrier to an adjacent one is a separate member and this involves a further difficult operation in assembling the blind, if it is particularly considered that the carriers are quite tiny pieces.

SUMMARY OF THE INVENTION

An object of the invention is to remedy the above drawbacks.

It is thus proposed that the slat suspender be made of two interlocked members, rather than just one, and that they be constructed so as to separate readily when a child applies a relatively small pull force on the one of the two members that supports the slat. The risk that the child be injured in a untimely fall can thus be considerably lowered.

More specifically and according to the invention, the central section of the carrier is formed with a neck portion having an open-ended bore opening into a chamber of the section which defines, with the bore, a flat shoulder. The rotary slat suspender, on the other hand, comprises an outer sleeve having a toothed end, intended to mesh with the worm of the drive section, and a cylindrical end rotatable in the neck portion; these ends making a flat shoulder between them which seats on the flat shoulder in the chamber. Additionally, the sleeve has an inner shoulder. The slat suspender also comprises a suspension member which has a slat suspension end and a coaxial mounting end, the latter having at least one release shoulder seating on the connection shoulder of the suspender outer sleeve. According to the invention, the mounting end and the shoulders are constructed so as to cause readily disengagement of the suspension member from the outer sleeve upon application of a pull force of predetermined magnitude on the suspension end.

In a preferred embodiment, the mounting end is a forked element which has a pair of tines capable of flexing toward one another upon the application of the aforesaid pull force. Each tine has one release shoulder and these release shoulders as well as the connection shoulder are inclined outwardly, with respect to the chamber, at an angle which is suitable to cause relative sliding between the shoulders when the pull force is applied.

Still preferably, the sleeve has a bore and a counterbore joined together by the aforesaid inclined inner connection shoulder and the spaced tines are formed, at their free ends, with outwardly directed bulges housed in the sleeve counterbore and defining the release shoulders mentioned above. The remaining portions of the tines define the aforesaid coaxial mounting end fitting loosely in the sleeve bore.

In order to provide easy adjustment of all the slats so that they be fully parallel when the blind is opened and that they all lie in the same general plane, when the blind is closed, the invention proposes that the one end of the outer sleeve be provided with straight axial gear teeth extending along a sector of the sleeve, of about 180°. It is also proposed that the drive section define a drive chamber having a common opening with the central section chamber and having a pair of opposed walls capable of resiliently flexing outwardly, the opposed walls extending normal to the common opening. With this in mind, the actuating means for rotating the slat suspender comprise a drive shaft and a drive mechanism. The latter comprises a worm portion which meshes with the toothed sector through the common opening and mounted free on the shaft; a drive portion mounted on the shaft for rotation with the shaft; bearing means mounting the worm and drive portions on the flexible opposed walls; clutch means allowing the worm and drive portions to move away from one another against the bias of the opposed resilient walls and thereby disengage the portions when the worm portion reaches one end of the sleeve toothed sector, and allowing the portions to lock when the worm portion rides between the ends of the toothed sector.

To simplify the assembly and dismantling or repair of the blind, the carrier section should be molded in one piece in plastic material and define an open-ended U-shaped passage extending parallel to the direction of displacement of the carrier. According to a further improvement, the connection section would further include an elongated connection pull-bar of predetermined width and thickness extending from the bottom of the passage centrally between its ends, this pull-bar having hinge means at one end which allow it to bend in the direction of displacement. A resilient lug is then provided above the bottom of the passage and at a distance from the bottom which is greater than the predetermined thickness of the pull-bar, these lugs facing one another across the passage and being spaced apart a distance smaller than the predetermined width of the pull-bar. In this manner, the lugs serve as means to guide the movement of an adjacent like carrier when the pull-bar is snapped into the spaces between the lugs and the bottom of the passage of the said like carrier. Finally, means are provided in the passage and on the pull-bar adjacent the hinge means for retaining the pull-bar within the passage.

A preferred embodiment of the invention will now be described having reference to the appended drawings.

DESCRIPTION OF THE PREFERRED EMBODIMENT

Figure 1:
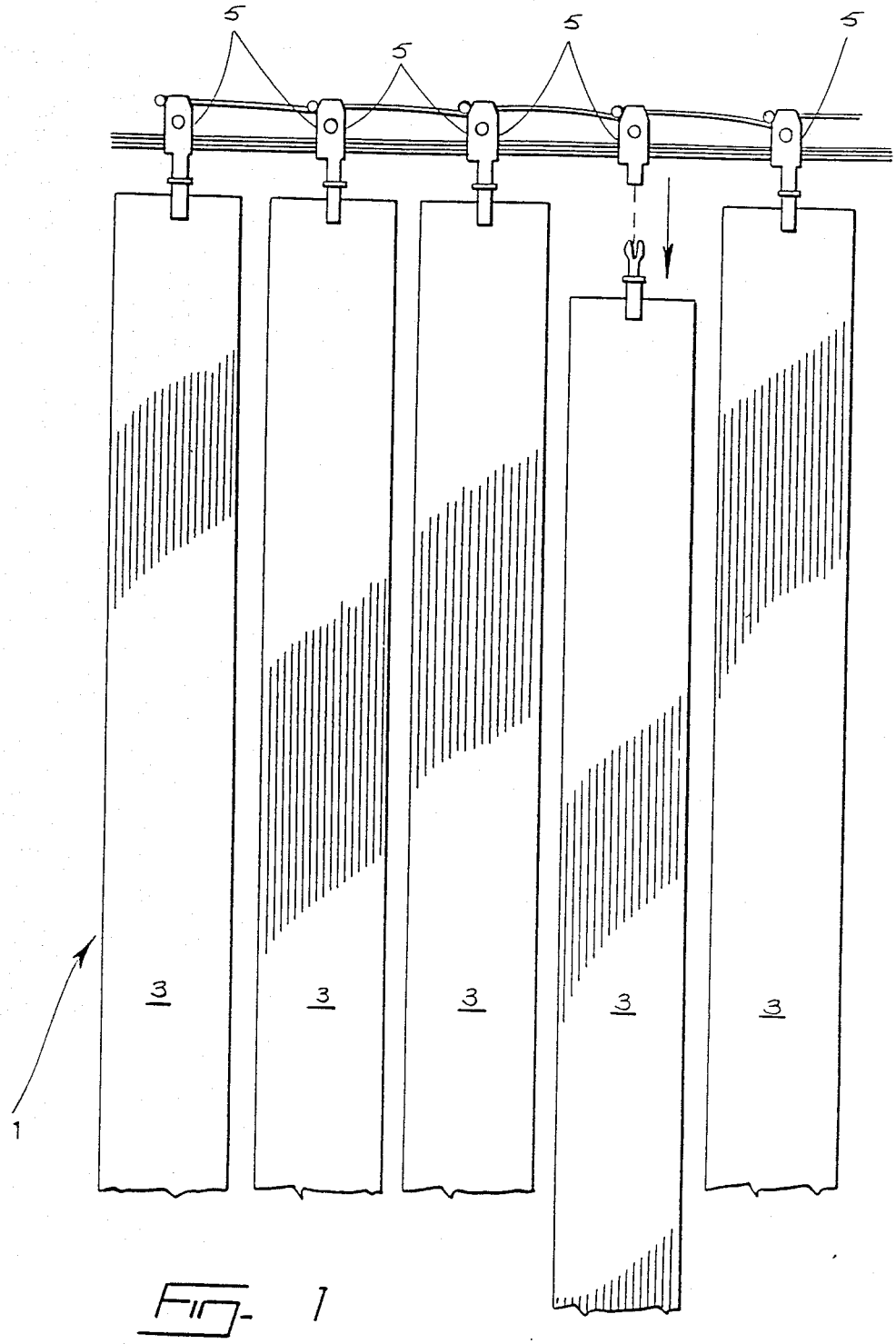
FIG. 1 is an elevation view of the carrier portion of a vertical blind, including the improvements of the invention.
Figure 3:
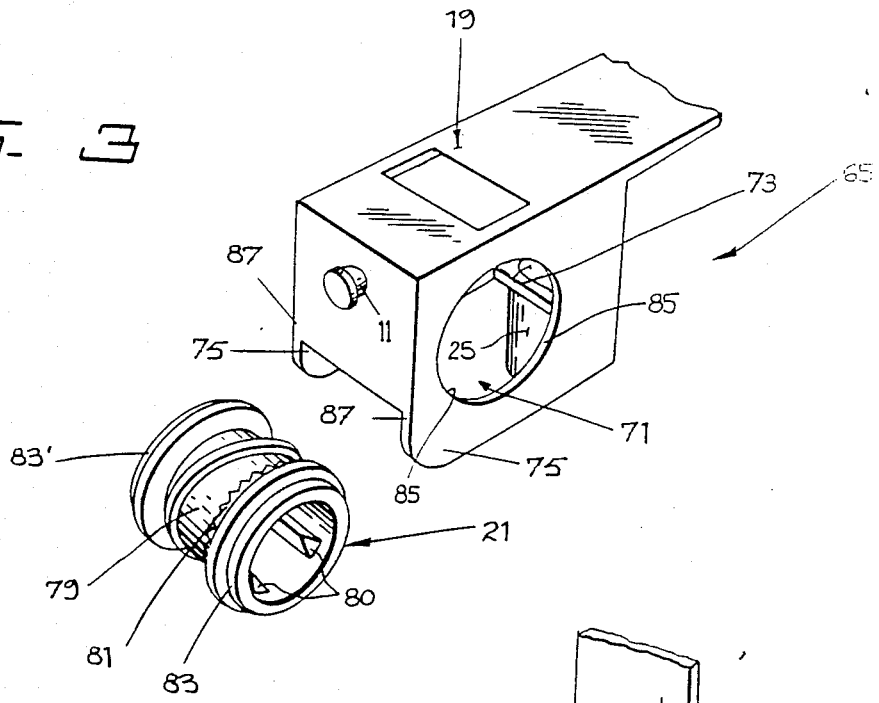
FIG. 3 is an exploded perspective view of the drive section of the carrier of FIG. 2.

The blind 1, of which a portion is shown in FIG. 1, is made up of multiplicity of like vertical slats 3 removably mounted on carriers 5 slidable along tracks 7 by means of rollers 9 snap-fitted on stub shafts 11 molded integral with the body 13 of the carrier 5. The latter has a central section 15 which contains a rotary slat suspender 17; a drive section 19 provided with actuating means 21 (detailed in FIGS. 3 and 6) for rotating the slat suspender 17, and a connection section 23 best seen in FIG. 7. The carrier 5 and all relevant pieces are preferably molded in plastic material.

Figure 2:
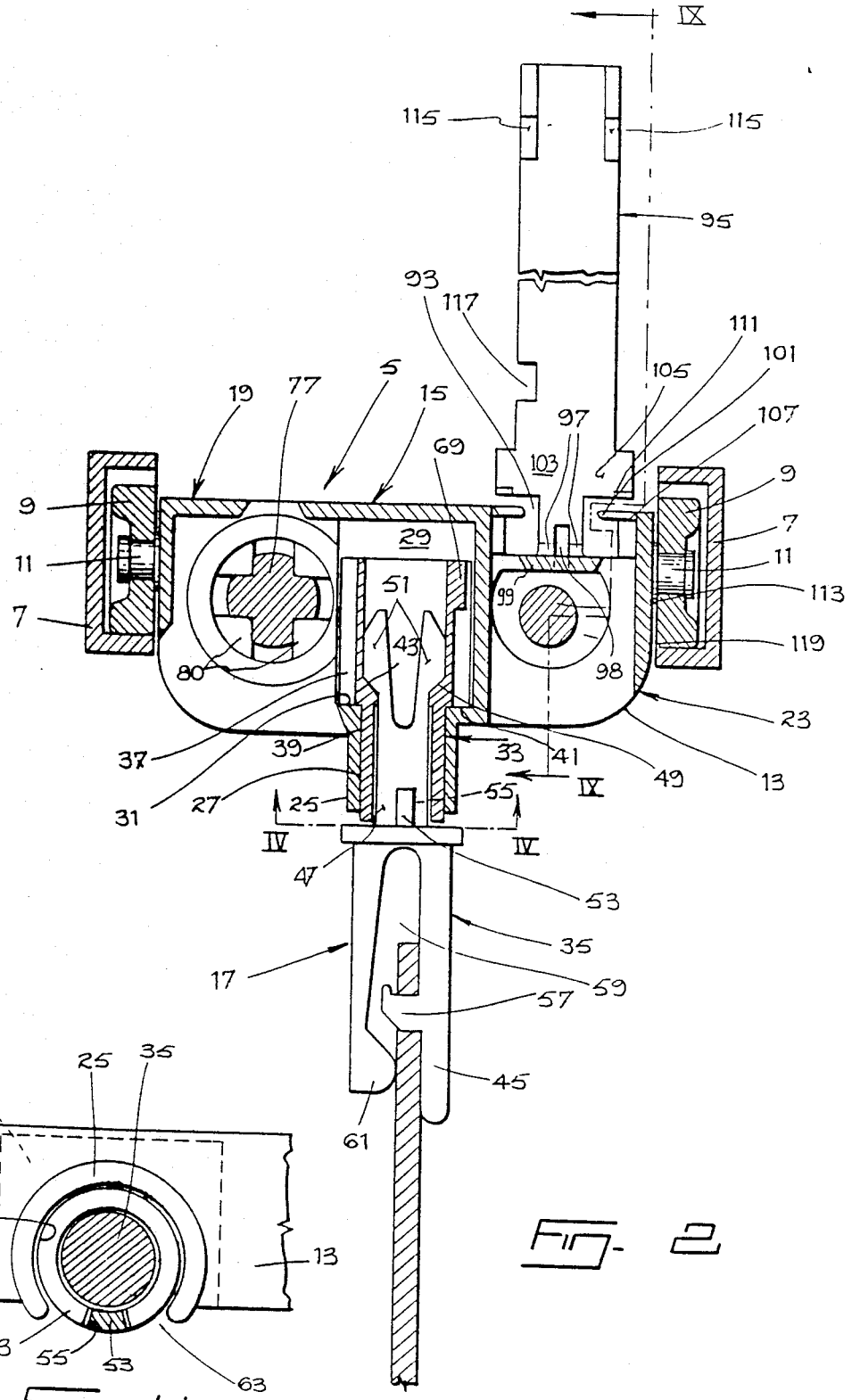
FIG. 2 is a cross-section mainly of a carrier made according to the invention.
Figure 4:
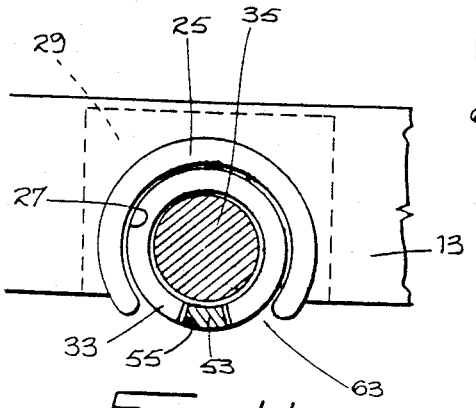
FIG. 4 appearing on the same sheet of drawings as FIG. 2 is a cross-sectional view along line IV—IV of FIG. 2.

Referring to FIGS. 2 and 4, it is seen that the central section 15 comprises a neck portion 25, molded with the carrier body 13 and having an open-ended bore 27 opening into a chamber 29 defining, with the bore 27, a flat shoulder 31.

The slat suspender 17 is formed of a rotary outer sleeve 33 into which is slid a suspension member 35.

Figure 5:
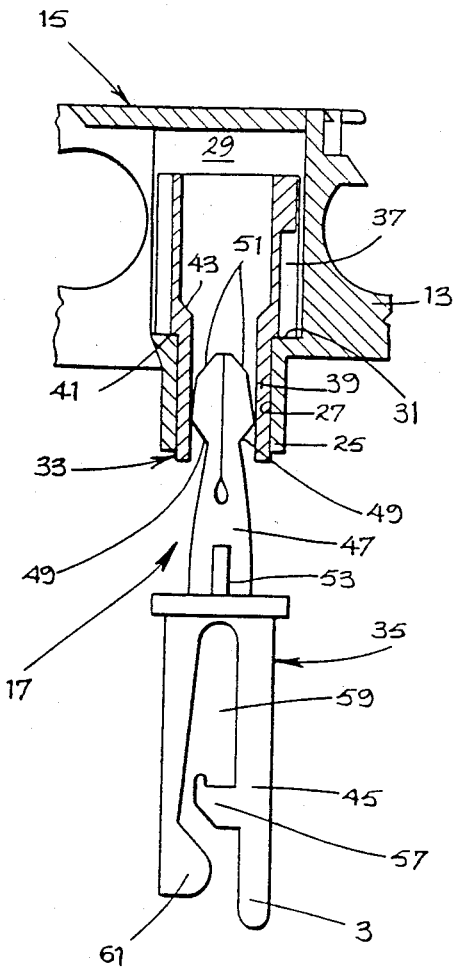
FIG. 5 is an elevational view of the rotary slat suspender with the slat suspender member being partly removed from the suspender sleeve.

Sleeve 33 has an upper end 37 housed in the chamber 29 and a cylindrical lower end 39 rotatably mounted in the bore 27 of the neck portion 25; the ends 37, 39, defining between them a flat shoulder 41 seating on the shoulder 31 of the chamber 29. The sleeve further has an inner connection shoulder 43 (FIGS. 2 and 5).

The suspension member 35, on the other hand, has a slat supporting end 45 (FIG. 5) and a coaxial mounting end 47, the latter being formed with a release shoulder 49 seating, as shown in FIG. 2, on the connection shoulder 43.

According to the invention, the mounting end 47 and the shoulders 43, 49, must be constructed to permit easy disengagement of the suspension member 35 from the outer sleeve 33 when a pull force of predetermined small magnitude is applied, by a child, on the suspension member 35 through a slat 3.

In the preferred embodiment illustrated, the mounting end 47 is a forked element with two tines 51 capable of resiliently flexing toward one another upon the application of the above pull force, the tines 51 each having one release shoulder 49. The latters and the connection shoulder 43 must be inclined downwardly sufficiently to cause relative sliding of the shoulders 43, 49, when the selected pull force has been reached, as shown clearly in FIG. 5. It will be noted that the sleeve 33 has a bore and a counterbore having, between them, the connection shoulder 43. Also, the upper free ends of the tines 51 have outwardly directed bulges, normally housed in the chamber 29, which define the release shoulders 49 facing the connection shoulder 43. The remaining portions of the tines 51, which form the mounting end 47 of the suspension member 35, fit loosely in the sleeve bore. For enhancing the resilient flexibility of the tines, the latter have their inner faces in the form of a V extending over a major portion of the forked mounting end 47.

Obviously, the suspension member 35 must rotate together with the sleeve 33 in unison and, for this purpose, releasable locking means must be provided therebetween which may simply be a short tab 53, at the upper end of the slat supporting end 45, inserted in a notch 55 (FIG. 2) at the lower end of the sleeve 33.

As for the slat 3, it may be suspended on the supporting end 45 in any convenient manner. It may thus be pierced with a top opening slid over a hook 57 inside a housing 59 which may also include a retaining ear 61.

FIG. 4 shows that the neck portion 25 is opened, parallel to its axis, and defines a slot 63 which leads into the chamber 29, the latter having an open face 65 (FIG. 6) in alignment with the slot 63. In this manner, the slat suspender 17 may easily be mounted on the carrier body 13 by first angularly inserting the upper end 37 of the sleeve 33 into the chamber 29 through its open end and then snapping the lower end 35 into the sleeve bore 27 through its slot 63.

Figure 6:
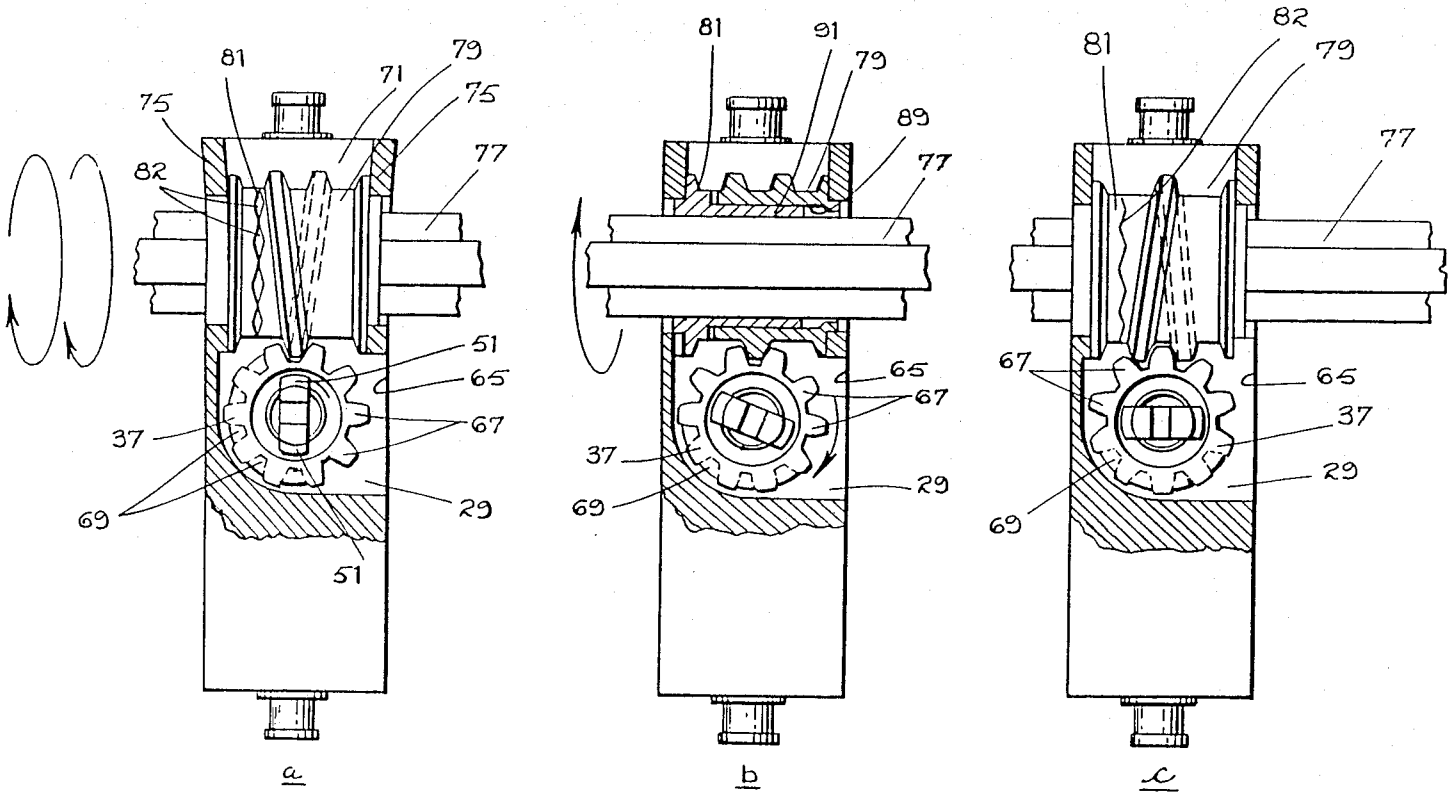
FIG. 6, *a*, *b* and *c* are three top plan views of the carrier showing the drive clutch and worm meshing with the gear of the slat suspender.

FIG. 6 shows that the upper end 37 of the sleeve 33 has straight gear teeth 67, parallel to its axis and extending along a sector of the sleeve of about 180°, the remaining sector being plain as at 69, shown also in FIG. 2. The drive section 19 of the carrier body 13 is seen, in FIG. 3, to define a drive chamber 71 having a common opening 73 with the central chamber 29 and having a pair of opposed walls 75 resiliently flexible outwardly and extending perpendicularly to the common opening 73.

The aforesaid actuating means 21 serving to rotate the slat suspender 17 include a cruciform drive shaft 77 and a drive mechanism rotated by the shaft. The drive mechanism comprises (FIGS. 3 and 6) a worm portion 79 meshing with the toothed sector of the sleeve 33, through the common opening 73, and mounted free on the shaft 77 (FIG. 6*b*). A drive portion 81 provided with internal ribs 80 is mounted on the shaft 77 for rotation therewith and bearings 83, 83', are provided on both portions 79, 81, for mounting on bearing openings 85 through the opposed resilient walls 75; the latter preferably having bevelled edges 87 for facilitating the positioning of the worm and drive portions into the drive chamber 71. Finally, the drive mechanism includes clutch means between the worm and drive portions 79, 81, to allow them to move away from one another against the bias of the resilient walls 75. Thus, the clutch means allow the portions 79, 81 to disengage from one another when the worm portion 79 reaches one end of the sleeve toothed sector and is stopped by its filled teeth 69 and allow them to lock when the worm portion 79 rides between the ends of the toothed section. This feature permits the readjustment of the position of some of the slats 3 that could have become out of alignment with the others.

In the embodiment shown, the worm portion 79 has a cylindrical bore 89 (FIG. 6*b*) and the drive portion 81 has an outwardly cylindrical hub 91 slidably received into the bore 89. As to the clutch means, they are serrations 82 (FIGS. 6*a* and *c*) formed on the facing end edges of the worm and drive portions. The serrations 82 are able to overrive one another when the worm portion 79 has been stopped by the filled teeth 69 as aforesaid, and are otherwise able to interlock, thereby causing rotation of the slat suspender 17.

As said before, the drive portion 81 is rotated by the shaft 77, the latter being cruciform in cross-section while the drive portion 81 is formed with bore ribs 80 operatively engaging it (see FIG. 2).

Figure 7:
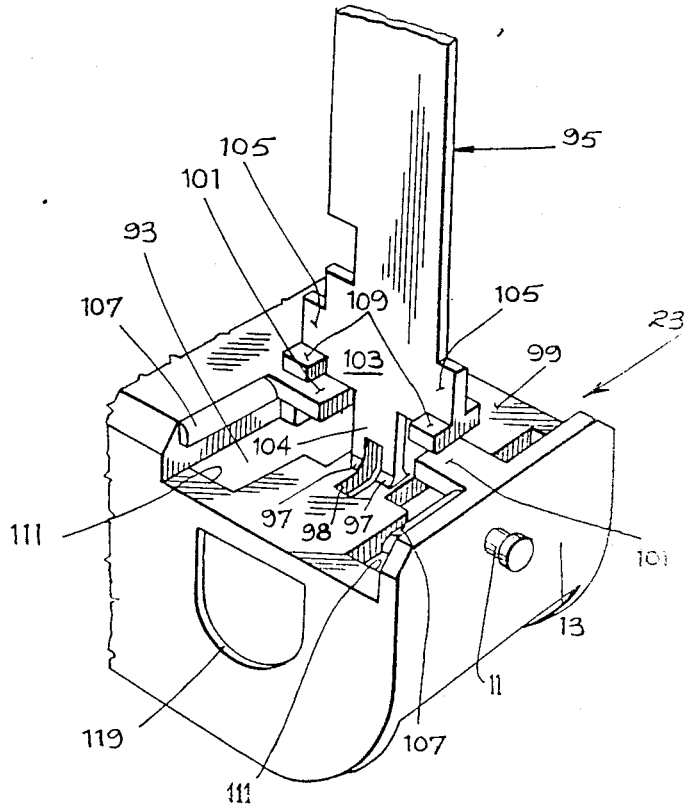
FIG. 7 appearing on the same sheet of drawings as FIG. 3, is a perspective view of the connection section of the carrier of FIG. 2.

Referring now to FIGS. 2 and 7, the carrier connection section 23 is, like the whole carrier body 13, molded in one piece in plastic material and defines an open-ended U-shaped passage 93 that extends parallel to the direction of displacement of the carrier. An elongated connection pull-bar 95 of predetermined width and thickness extends from the bottom of the passage 93 centrally between its ends. As it comes out of the mould, the pull-bar stands straight up. The pull-bar is provided, at its lower end 103, with a thin-down transverse part 97 which acts as a hinge, the latter connecting immediately with a bridge 99 of the bottom of the passage 93. An inverted T-shaped opening 98 is preferably provided through a narrowed tip 104 of the lower end 103 and through the bridge 99, as best seen in FIG. 7, to assist in the hinge action. The pull-bar 95 may thus be bent in the direction of displacement of the carrier 5 to be operatively connected to the next carrier, in the following manner.

A resilient lug 101 is provided on either side of the passage 93 and spaced above its bottom a distance greater than the aforesaid predetermined thickness of the pull-bar 95. The lugs 101 face one another across the passage 93 and their tips are separated a distance smaller than the also previously mentioned predetermined width of the pull-bar.

It may be pointed out at this time that the tip 104 of the lower end 103 of the pull-bar 95 is located between the two lugs 101 and is narrower than the space between them.

Figure 8:
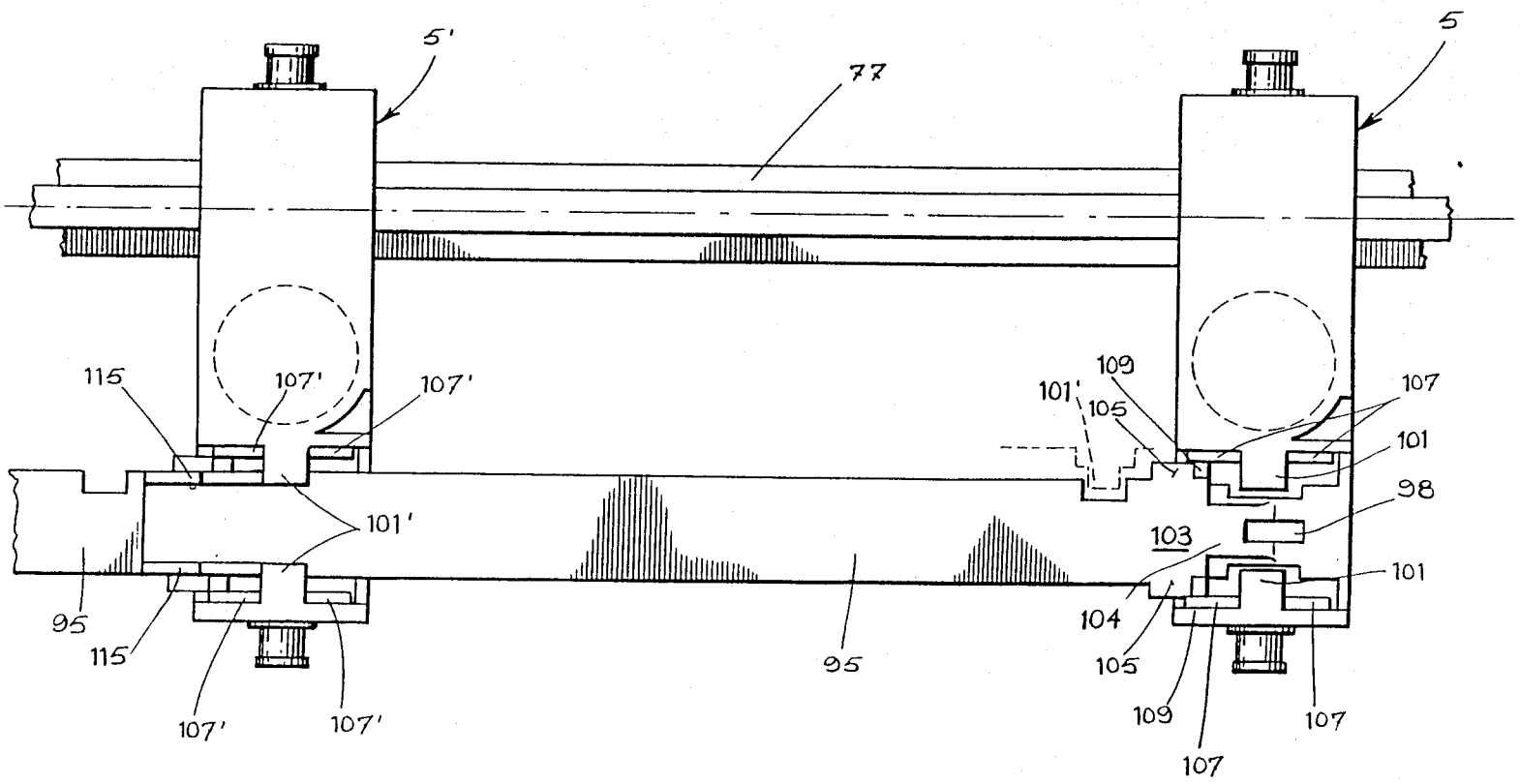
FIG. 8 is a top plan view of a portion of the blind involving two successive carriers connected together.

With this description in mind and referring to the leftward end of FIG. 8, it will be seen that the free end of the horizontally bent pull-bar 95 may be snapped fitted beneath the lugs 101' of an adjacent like carrier 5', which lug 101' thus serve in guiding the sliding movement of the adjacent carrier 5' toward and away from the carrier 5. In this situation also, the pull-bar 95 stands above the bent pull-bar 95' of carrier 5', as is also evident from FIGS. 9 and 10.

Figure 9:
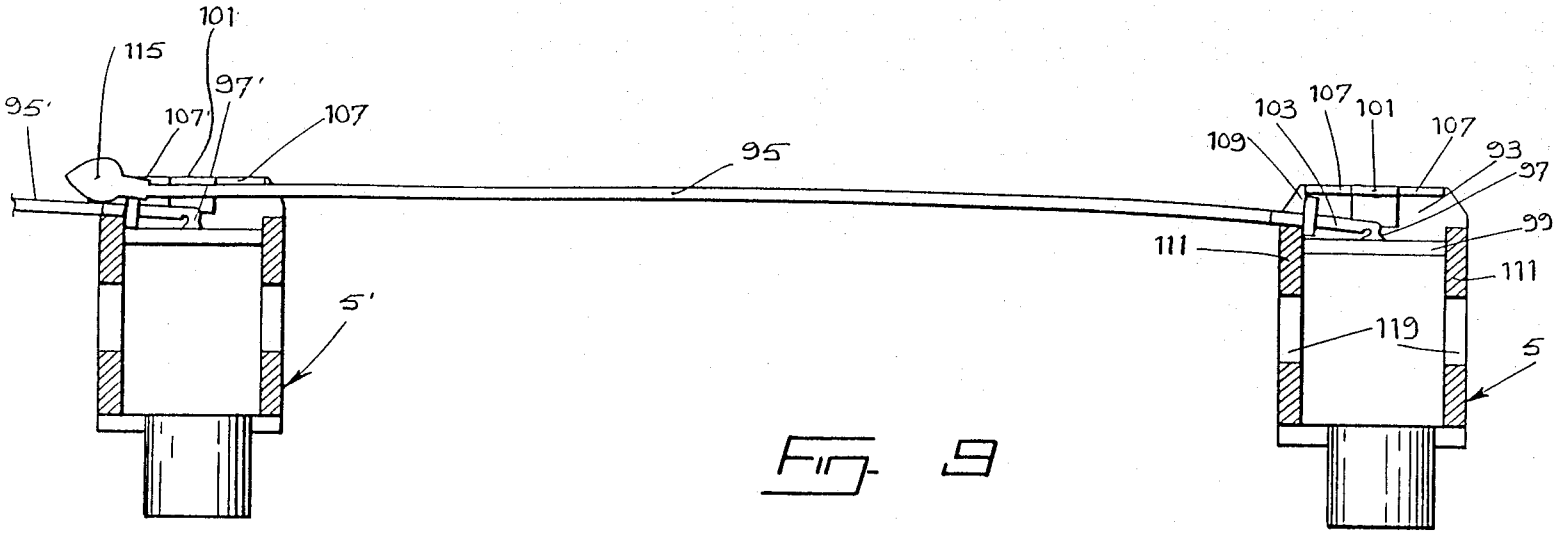
FIG. 9 is a side elevation view of the two carriers of FIG. 8.
Figure 10:
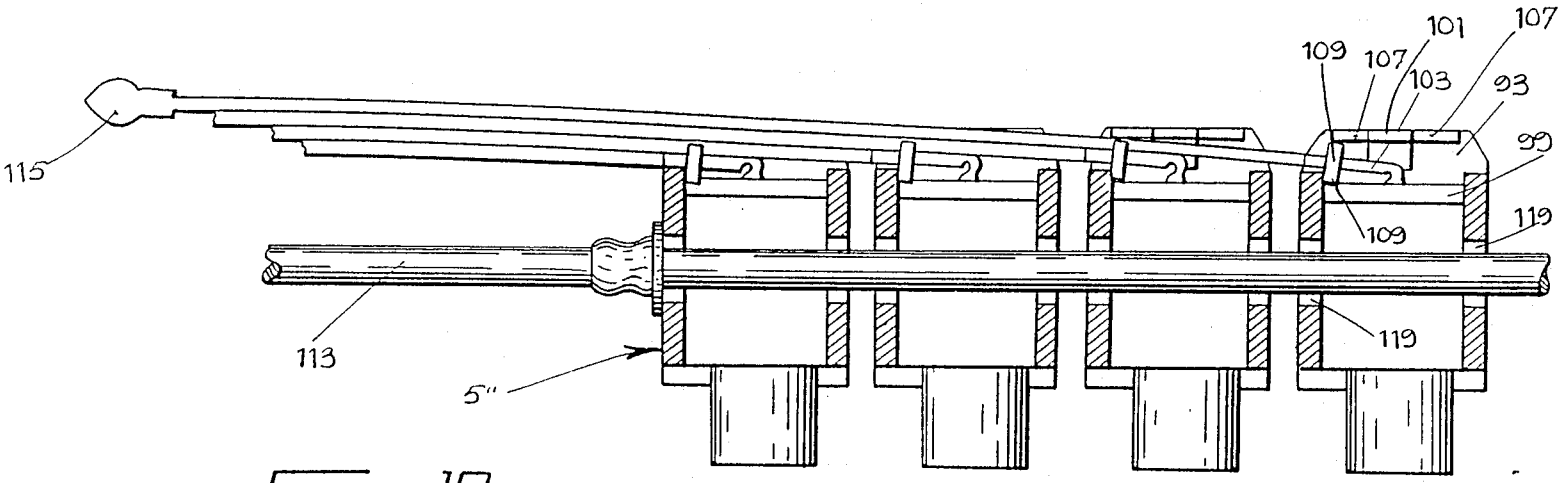
FIG. 10 is an elevation view of four carriers clustered together in the open condition of the blind.

It will be appreciated also from FIGS. 8, 9 and 10, that the lower end 103 has to be retained within the passage 93. For this purpose, wings 105 are provided immediately above the tips 104, of which the lateral edges are spaced apart a predetermined distance suitable to coact with resilient detents 107 located next to and on either side of the lugs 101. The spacing between the detents 107, across the passage 93, is less than that between the lateral edges of the wings 105 so that the latter are snap-fitted behind the detents 107 when the pull arm 95 is bent, as best seen in FIG. 10. In this manner, the pull-arm is prevented from moving out of the passage 93.

Also provided on and projecting away from the wings 105 are stop blocks 109 coacting with stop walls 111 located at the ends of the passage 93. By this means, the stop blocks 109 engage the inner faces of the stop walls 111 when the pull-bar 95 is bent into the passage as shown in FIGS. 9 and 10; the stop-blocks being located on either side of the wings 105. This construction allows a leftward pull applied on the operating endless chord 113 (FIG. 10), secured to the last carrier 55'', to be borne by the walls 111 rather than by the weaker hinges 97 of all carriers.

It may be noted, at this time, that the connection section 23 is symmetrical with respect to a central plane of the pull-bar 95 when the latter is upright (see FIGS. 2 and 7).

Referring to FIGS. 2 and 9, 10 a pair of stop ears 115, projects perpendicularly from each side of the plane of the flat pull-bar 95, at its free end add along its lateral edges. These ears may be in the form of pears (FIGS. 9, 10) and the distance between their outer faces exceeds that between the resilient lugs 101 so that, in use, stop ears 115 are intended to abut the ends of the resilient lugs 101' of an adjacent carrier 5' (FIGS. 8 and 9) when the cord 113 has moved all carriers in open position of the blind; the cord extending freely through suitable holes 119 of the carrier body 13.

To ease in the piling up of pull-bars 95, in the manner shown in FIG. 10, each pull-bar may be notched, as at 117, for lodging the lugs 101 of successive pull-bars, as illustrated in FIG. 8.

I claim:

1. A carrier for vertically supporting a slat of a vertical blind, said carrier including a section provided with a rotary slat suspender; a drive section provided with actuating means for rotating said slat suspender; and a connection section provided with means for joining said carrier to an adjacent carrier of said vertical blind, wherein said slat suspender section comprises:

a neck portion having an open-ended bore opening into a chamber of said slat suspender section and defining therewith a flat radial shoulder; and wherein said rotary slat suspender comprises:

a rotary outer sleeve having one end housed in said chamber and a cylindrical end rotatably mounted in said neck portion bore, said needs defining a flat radial shoulder therebetween seating on said chamber flat shoulder; said sleeve further having an inner connection shoulder;

a suspension member having a slat suspension end and a coaxial mounting end; said mounting end having at least one release shoulder seating on said connection shoulder of said rotary outer sleeve; said mounting end and said shoulders being constructed so as to cause readily disengagement of said suspension member from said outer sleeve upon application of a pull force of predetermined magnitude on said suspension end; and wherein said mounting end is a forked element having a pair of tines capable of flexing toward one another upon application of said pull force; said tines each having said one release shoulder; said release shoulders and said connection shoulder being inclined outwardly with respect to said chamber, at an angle suitable to cause sliding therebetween when said pull force is applied.

2. A carrier as claimed in claim 1, wherein said sleeve has a bore and a counterbore joined together by said inclined inner connection shoulder and said spaced tines are formed, at the free ends thereof, with outwardly directed bulges housed in said sleeve counterbore and defining said release shoulders; the remaining portions of said tines defining said coaxial mounting end fitting loosely in said sleeve bore.

3. A carrier as claimed in claim 2, wherein the faces of said tines opposing one another define therebetween a V-shaped opening extending over a major portion of said forked end of said suspension member for enhancing the flexibility of said tines.

4. A carrier as claimed in claim 2, further comprising releasable locking means between said rotary outer sleeve and said suspension member for allowing said sleeve and said member to rotate in unison.

5. A carrier as claimed in claim 4, wherein said outer sleeve has a notch along the periphery of the terminal edge thereof and said releasable locking means comprise a tab at the junction of said outer sleeve and said suspension member, said tab engaging into said notch to ensure rotation of said suspender when said outer sleeve is rotated.

6. A carrier as claimed in claim 3, wherein said one end of said outer sleeve has straight axial gear teeth extending along a sector of said sleeve, of about 180°; wherein said drive section defines a drive chamber having a common opening with said central section chamber and having a pair of opposed walls capable of resiliently flexing outwardly, said opposed walls extending normal to said common opening, and wherein said actuating means for rotating said slat suspender comprises:

a drive shaft, and a drive mechanism comprising:

a worm portion meshing with said toothed sector through said common opening and mounted free on said shaft;

a drive portion mounted on said shaft for rotation therewith;

bearing means mounting said portions on said flexible opposed walls;

clutch means allowing said portions to move away from one another, against the bias of said opposed resilient walls and thereby disengage said portions when said worm portion reaches one end of said sleeve toothed sector, and allowing said portions to lock when said worm portion rides between the ends of said toothed sector.

7. A carrier as claimed in claim 6, wherein said worm portion has a cylindrical bore and said drive portion has an outwardly cylindrical hub slidably received into said bore.

8. A carrier as claimed in claim 7, wherein said clutch means comprise serrations formed on facing end edges of said work and drive portions and capable of interlocking and disengaging from one another.

9. A carrier as claimed in claim 8, wherein said drive shaft is cruciform in cross-section and said drive portion has a bore of like cross-section to be driven by said drive shaft.

10. A carrier as claimed in claim 9, further comprising releasable locking means between said rotary outer sleeve and said suspension member for allowing said sleeve and said member to rotate in unison.

11. A carrier as claimed in claim 6, wherein said neck portion is axially opened to define a slot for the snap insertion therein of said outer sleeve.

12. A carrier as claimed in claim 2, wherein said carrier connection section is molded in one piece in plastic material and defines an open-ended U-shaped passage extending parallel to the direction of displacement of said carrier, said connection section further including:

an elongated connection pull-bar of predetermined width and thickness extending from the bottom of said passage centrally between the ends thereof, said pull-bar having hinge means at one end for allowing it to bend in said direction of displacement;

a resilient lug, on either side of said passage, located above the bottom thereof a distance greater than the predetermined thickness of said pull bar, said lugs facing one another across said passage and being spaced apart a distance smaller than the said predetermined width of said pull-bar whereby to serve as means to guide the movement of an adjacent like carrier when said pull-bar is snapped in the space between the lugs and the bottom of the passage of said like carrier; and means in said passage and on said pull-bar adjacent said hinge means, for retaining said pull-bar within said passage.

13. A carrier as claimed in claim 12, wherein said retaining means comprise:

wings, adjacent said hinge means, laterally projecting from said pull-bar and of which the tips are spaced apart a predetermined distance;

resilient detents, on either side of said passage next to said resilient lugs; said detents facing one another across said passage and being spaced apart a distance smaller than said wing tips predetermined distance thereby preventing said pull-bar to move out of said passage.

14. A carrier as claimed in claim 12, wherein said one end of said outer sleeve has straight axial gear teeth extending along a sector of said sleeve, of about 180°; wherein said drive section defines a drive chamber having a common opening with said central section chamber and having a pair of opposed walls capable of resiliently flexing outwardly, said opposed walls extending normal to said common opening, and wherein said actuating means for rotating said slat suspender comprises:

a drive shaft, and a drive mechanism comprising:

a worm portion meshing with said toothed sector through said common opening and mounted free on said shaft;

a drive portion mounted on said shaft for rotation therewith;

bearing means mounting said portions on said flexible opposed walls;

clutch means allowing said portions to move away from one another, against the bias of said opposed resilient walls and thereby disengage said portions when said worm portion reaches one end of said sleeve toothed sector, and allowing said portions to lock when said worm portion rides between the ends of said toothed sector.

15. A carrier as claimed in claim 14, wherein said neck portion is axially opened to define a slot for the snap insertion therein of said outer sleeve.

16. A carrier as claimed in claim 12, wherein said pull-bar hinge means define an inverted T-shaped opening at the junction of the lower end of said pull-bar and said bottom of said U-shaped passage.

17. A carrier as claimed in claim 16, wherein said pull-bar hinge means further comprise a thin-down transverse part of said lower end of said pull-bar.

18. A carrier as claimed in claim 2, wherein said neck portion is axially opened to define a slot for the snap insertion therein of said outer sleeve.

19. A carrier as claimed in claim 1, further comprising releasable locking means between said rotary outer sleeve and said suspension member for allowing said sleeve and said member to rotate in unison.

20. A carrier for vertically supporting a slat of a vertical blind, said carrier including a central section provided with a rotary slat suspender; a drive section, on one side of said central section, provided with actuating means for rotating said slat suspender; and a connection section, on the other side of said central section, provided with means for joining said carrier to an adjacent carrier of said vertical blind, wherein said central section comprises:

neck portion having an open-ended bore opening into a chamber of said central section and defining therewith a flat shoulder;

a rotary outer sleeve having one end housed in said chamber and a cylindrical and rotatably mounted in said neck portion bore, said ends defining a flat shoulder therebetween seating on said chamber flat shoulder; said sleeve further having an inner connection shoulder, and a suspension member having a slat suspension end and a coaxial mounting end; said mounting end having at least one release shoulder seating on said connection shoulder of said suspender outer sleeve; said mounting end and said shoulders being constructed so as to cause readily disengagement of said suspension member from said outer sleeve upon application of a pull force of predetermined magnitude on said suspension end;

wherein said mounting end is a forked element having a pair of tines capable of flexing toward one another upon application of said pull force, said tines each having one release shoulder; said release shoulders and said connection shoulder being inclined outwardly, with respect to said chamber, at an angle suitable to cause sliding therebetween when said pull force is applied;

wherein said sleeve has a bore and a counterbore joined together by said inclined inner connection shoulder and said spaced tines are formed, at the free ends thereof, with outwardly directed bulges housed in said sleeve counterbore and defining said release shoulders; the remaining portions of said tines defining said coaxial mounting end fitting loosely in said sleeve bore;

wherein said carrier connection section is molded in one piece in plastic material and defines an open-ended U-shaped passage extending parallel to the direction of displacement of said carrier, said connection section further including:

an elongated connection pull-bar of predetermined width and thickness extending from the bottom of said passage centrally between the ends thereof, said pull-bar having hinge means at one end for aligning it to bend in said direction of displacement;

a resilient lug, on either side of said passage, located above the bottom thereof a distance greater than the predetermined thickness of said pull bar, said lugs facing one another across said passage and being space part at a distance smaller than the said predetermined width of said pull-bar whereby to serve as means to guide the movement of an adjacent like carrier when said pull-bar is snapped in the spaces between the lugs and the bottom of the passage of said like carrier; and means in said passage and on said pull-bar adjacent said hinge means, for retaining said pull-bar within said passage; and wherein said preventing means comprise:

wings, adjacent said hinge means, laterally projecting from said pull-bar and of which the tips are spaced apart a predetermined distance;

resilient detents, on either side of said passage next to said resilient lugs, said detents facing one another across said passage and being spaced apart a distance smaller than said wing tips predetermined distance thereby preventing said pull-bar to move out of said passage; and further comprising: stop blocks on and projecting away from said wings in said direction of displacement of said carrier, and stop walls at the ends of said passage, constructed so that said stop blocks engage the inner face of said stop walls when said pull-bar is bent into said passage.

21. A carrier as claimed in claim 20, further comprising stop earing projecting perpendicularly of said pull-bar along the lateral edges there of and at the end thereof away from said hinge means, the distance between said ears extending that between said resilient lugs so as the engage resilient cars of an adjacent carrier when said pull bar of said carrier pulls thereon.

22. A carrier for vertically supporting a slat of a vertical blind, said carrier comprising a connection section provided with means for joining said carrier to an adjacent carrier of said vertical blind, wherein said carrier connection section is molded in one piece in plastic material and defines an open-ended U-shaped passage extending parallel to the direction of displacement of said carrier, said connection section further including:

an elongated connection pull-bar of predetermined width and thickness extending from the bottom of said passage centrally between the ends thereof, said pull-bar having hinge means at one end for allowing it to bend in said direction of displacement;

a resilient lug, on either side of said passage, located above the bottom thereof a distance greater than the predetermined thickness of said pull-bar, said lugs facing one another across said passage and being spaced apart a distance smaller than the said predetermined width of said pull-bar whereby to serve as means to guide the movement of an adjacent like carrier when said pull-bar is snapped in the space between the lugs and the bottom of the passage of said like carrier; and means in said passage and on said pull-bar adjacent said hinge means, for retaining said pull-bar within said passage.

* * * * *